US005323742A

United States Patent [19]

Hamada

[11] Patent Number: 5,323,742

[45] Date of Patent: Jun. 28, 1994

[54] SHIM STRUCTURE IN USE FOR VALVE TAPPET OF INTERNAL COMBUSTION ENGINE

[75] Inventor: Akihiro Hamada, Machida, Japan

[73] Assignee: Fuji Oozx, Inc., Kanagawa, Japan

[21] Appl. No.: 111,629

[22] Filed: Aug. 25, 1993

[30] Foreign Application Priority Data

Mar. 26, 1993 [JP] Japan ..... 5-090479
Mar. 26, 1993 [JP] Japan ..... 5-090480

[51] Int. Cl.[5] ..... F01L 1/14

[52] U.S. Cl. ..... 123/90.48; 123/90.51; 74/569

[58] Field of Search ..... 123/90.48, 90.51; 74/569

[56] References Cited

U.S. PATENT DOCUMENTS 3,078,194 2/1963 Thompson ..... 123/90.51
4,230,491 10/1980 Behnke ..... 123/90.51
4,366,785 1/1983 Goloff et al. ..... 123/90.51
4,430,970 2/1984 Holtzberg et al. ..... 123/90.51
4,873,150 10/1989 Doi et al. ..... 123/90.51
4,909,198 3/1990 Shiraya et al. ..... 123/90.51
5,060,607 10/1991 Taniguchi ..... 123/90.51
5,249,554 10/1993 Tamor et al. ..... 123/90.51

FOREIGN PATENT DOCUMENTS 60-131604 9/1985 Japan .
60-183207 12/1985 Japan .
383307 8/1991 Japan .

*Primary Examiner*—Raymond A. Nelli
*Assistant Examiner*—Weilun Lo
*Attorney, Agent, or Firm*—Poms, Smith, Lande & Rose

[57] ABSTRACT

There is provided a structure of a shim to be inserted in a clearance provided between a cam and a tappet in a moving valve mechanism of an internal combustion engine, wherein a volumetric density of the shim body is changed such that it is maximized at an upper surface of the shim, at which the shim is in contact with the cam when a compression load or shock from the cam is applied to the shim, and the density is gradually decreased from the maximized portion to a lower or peripheral portions.

3 Claims, 2 Drawing Sheets

SHIM STRUCTURE IN USE FOR VALVE TAPPET OF INTERNAL COMBUSTION ENGINE

FIELD OF THE INVENTION

The present invention relates to a new structure of a valve clearance adjusting shim to be provided and to be inserted directly between a valve tappet and a cam for an overhead valve engine with a camshaft placed in an internal combustion engine. Particularly, it relates to the shim structure with improved strength profile with specific density distribution, which has optionally higher strength at the portion at which the shim is in contact with a cam surface.

DESCRIPTION OF THE PRIOR ART

A typical moving valve in use for an internal combustion engine may comprise an engine valve, a valve spring to press the valve to a closed position, a valve spring retainer for transmitting a pressure of the spring to the valve, a valve holder to hold the valve spring on a valve shaft, a tappet reciprocating to open and close the valve, by a rotation of a cam shaft, and a rotating cam shaft.

There are various ways of causing the intake and exhaust valves to open and close. For example, in four-stroke cycle engine, when the crankshaft turns, the camshaft must turn on which a number of cams are provided. These cams are simply raised sections or collars, with high spots on them. When the camshaft rotates, the high spots (called lobes) move around and push away anything they are in contact with. Riding on each cam is a valve tappet. As the lobe moves down on the valve tappet, the valve tappet goes down. This downward movement causes the valve above it to go down also. Thus, the valve goes down off its seat in the engine cylinder so that the valve opens. When the lobes on the cam move around out of the way, the pressure of the spring under the valve forces the valve to move up and reseat. At the same time, the valve tappet is also forced upward so that it remains in contact with the cam.

There is provided a clearance between a cam and a tappet, for adjustment against dimensional change due to heat expansion and/or friction. A plate or disc is inserted in this clearance so as to adjust the valve movement. This plate is called, or referred to as a clearance adjustment shim or only a shim. Further, there may be provided a metal tip made of the same metal as that of the tappet, or the different metal at the end position with which the engine valve is in contact. In this case, this tip is called an "intershim", and then, the shim to be inserted in the clearance is called an "outershim", so as to discriminate one from the other. The product of the present invention comprises an outershim.

Japanese Patent Laid-open application No. 60-131604/1985 proposed an oil holding surface of a shim at the peripheral portion thereof having many small holes to contain oil, so as to reduce wear or abrasion of the cam which reciprocates to give force to the surface of the shim.

Further, Japanese Patent Laid-open application No. 60-183207/1985 proposed use of sintered steel for the valve shim to improve strength against the shock from the tapped rod motion.

Japanese Patent Laid-open application No. 3-83307/1991 proposed an internal hollow(s) or concaved hollow provided within the shim to reduce its weight.

In a moving valve mechanism, a cam mounted on a camshaft pushes the valve through the shim, so as to open and close acutely periodically the valve to comply the timing of the valve with the revolution rate of the engine. Therefore, much shock and concentrated force must be loaded periodically and repeatedly on the contact surface of the shim to which the cam or lobe contacts. Then, the stress is caused within the shim.

The present invention can not be restricted by the following theory of the load and strain which is caused on the shim. The compression load which is repeatedly loaded on the surface of the shim from the moving cam may change depending on the rotation rate of the camshaft, and then, would be 100 to 200 kg/mm$^2$ on average.

The allowance of the strain to be applied to the shim is about 100 to 150 kg/mm$^2$. The compression load from the cam is repeatedly applied on the shim, and then, the maximal strain is caused at the portion of the surface of the shim, which is in contact with the cam. The compression force is transmitted in form of deformed spindle form with maximum diameter at the upper portion, through the shim to the tappet on which the shim is mounted. Therefore, each time when the cam is in contact with the shim, the vertical strain is caused from the position at which the shim is in contact with the cam.

Therefore, the shim does not need a uniform strength over the whole surface of the shim in view of metal solid structure and from a practical view. It is necessary for the shim only to have enough strength merely at the portion on which the load is applied to the shim, by the moving of the cam, or the shock from the cam. The prior art shim structure is restricted by the requirement that it should have uniformly high density over the whole body by a compression formation process.

SUMMARY OF THE INVENTION

It is an object of the present invention to provide a valve clearance adjusting shim having optionally higher abrasion strength of the surface portion of the shim merely at the portions at which the shim is in contact or is encountering friction with the surface of the cam and/or is repeatedly receiving shock from the cam.

It is the other object of the present invention to eliminate the restriction due to forming and/or shaping method in manufacturing the shim by sintering treatment, so as to expand the choice of the condition for manufacture of the clearance adjustment shim.

The further object of the present invention will be understood from the below description.

DETAILED DESCRIPTION OF PREFERRED EMBODIMENTS

Figure 1:
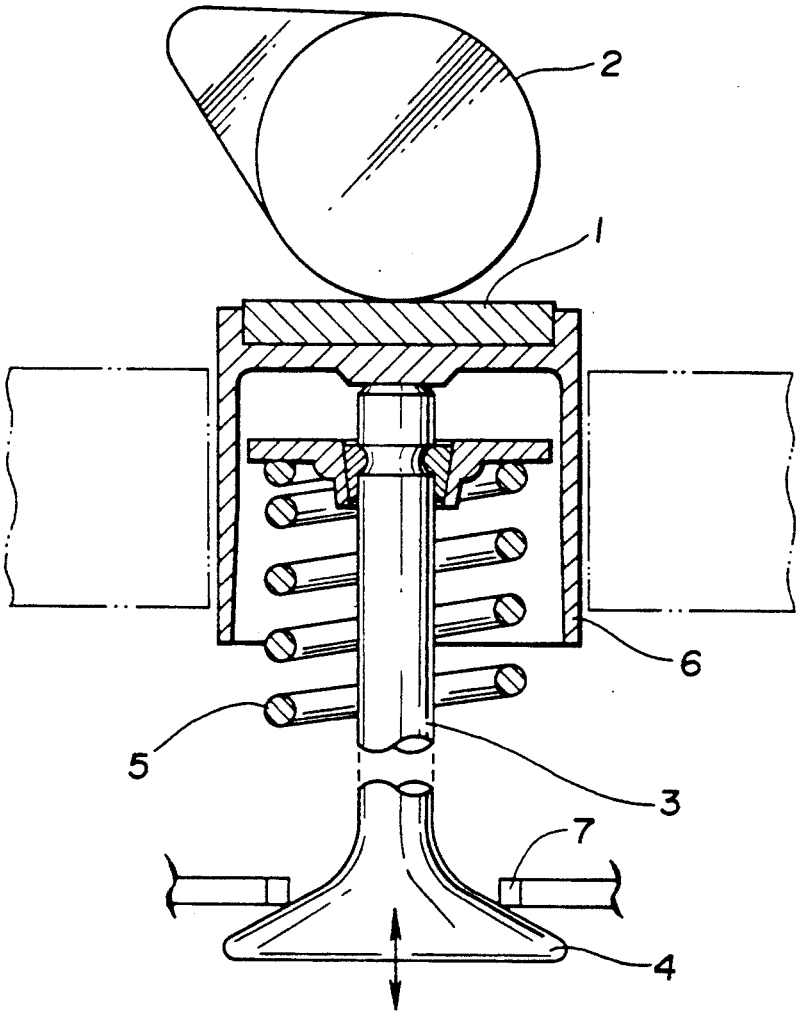
FIG. 1 shows schematically a cross section of a cam-valve tappet movement mechanism using the shim of the present invention.

In accordance with the present invention, the shim should have a profile wherein the volumetric density is maximized at the portion on which the shim is in contact with the cam, and then is gradually decreased along with the line apart from the maximum portion. The shim of the present invention has a particular and unique distribution of volumetric density. Therefore, this invention is not restricted particularly by any of the material composition used and the formulation of the components. Preferably, the product of the present invention comprises a powder metallurgical metal or a ceramic material.

First of all, the present invention is described in reference to a powder metallurgical metal for the material of the shim body.

One of the methods of producing the densified or enough sintered material is a hot pressing process of the prefired particulate material.

Powder metallurgy has the following characteristics; i) not-easy meltable material having higher melting point can be formed into a desired shape, ii) a shape and size accuracy is so high that further finishing step is not necessary, and the yield is high with simplified process, and iii) productivity is so high, and economy of the process is high. Therefore, the powder metallurgical process has been widely used for manufacture of automobile parts and elements.

Metal or alloy which can be used for a powder metallurgic process in accordance with the present invention may include Fe-based, Al-based and Ti-based alloy. Fe-based alloy may include Mo-Ni-Cu-Cr steel, Mo-Cr-Ni steel. Al-based alloy may include Al-Fe-Si alloy and Al-Si alloy. Ti-based alloy may be Ti-V-Al alloy. One of examples of Fe-based alloy is the composition comprising 0.5% C, 0.85% Si, 0.20% Mn, 1.0% Ni, 17.0% Cr, 8.0% Mo, 1.0% $CaF_2$ and balancing Fe. The another example is the composition comprising 0.7–1.3% C, 0.5–1.0% Nb, 4.0% Ni, 1.0–3.0% Cr, 5–8% Mo, 1.0% Co, 1.0% or more $CaF_2$ and balancing Fe. One example of Al-based alloy is the composition comprising 11.7% Si and balancing Al. Another example of Al-based alloy is the composition comprising 10–20% Si, 5–10% Fe, trace of V, Cu and Mo, and balancing Al.

The particle size of metal and/or alloy powder to be used ranges 0.1 to 0.0001 mm, and preferably 0.1 to 5 micrometer or submicron order for higher hardness.

The size, size distribution, particle size, particle feature, apparent density, compressibility, formability and compactibility of the metal and/or alloy powder to be used should be totally accessed and evaluated when the shim is manufactured.

The starting material metal and/or alloy to be used in accordance with the present invention should be selected in view of the characteristics of the sintering metal and alloy. There is no limitation of the starting material metal and/or alloy to be used in accordance with the present invention. For example, abrasion resistant Al alloy is preferable. Further, Si rich Al-Si based alloy, Ti alloy and Co-based alloy containing Cr, W and Fe are preferable because they can be manufactured by quench-solidification process.

After desired starting materials of metal or alloy powders are prepared, they are mixed with desired ratio. For example, 70–90% of Al, 5–10% of Fe, 10–20% Si, and other trace amounts of V, Mo, Cu are mixed. Further, alloy powders of Al-base-33Cu-7Mg, Al-base-6Zn-3Mg, Al-base-5.6Zn-2.5Mg-1.6Cu-0.3Cr, Al-base-10.7Zn-0.9Mg-0.4Zr are prepared in accordance with the designed formulations.

In mixing process, a strength-improving agent such as Cu, Ni and C, and a sintering accelerating agent such as Cu and Fe-P as well as a lubricating agent such as zinc stearate are added if necessary.

The resulting mixture is pressed to form a desired shape. Further, hot isostatic pressing (HIP), hot isostatic pressure sintering, pseudo HIP, injection moulding can be used in the manufacture of the shim by sintering of the product.

Sintering in ambient atmosphere can be carried out in a continuous furnace with feeding a protective gas (inert gas such as nitrogen gas) by preheating at about 500° C. to vaporize or to decompose a lubricating agent, and then heating at 1100° to 1200° C.

As known in the art, the resulting sintered product is post-treated or post-worked in accordance with the purpose of the product. For example, dimensional accuracy can be improved by sizing of the product. The strength can be improved by role working, and thermal treatment. Resistance to abrasion can be improved by infiltration, impregnation, oil-impregnation, and thermal surface treatment. Further, stain-proofing is improved by impregnation, oil-impregnation and surface treatment.

It is known that the strength of iron-based sintered metal is proportional to the density thereof to some extent, and then would be constant at the higher range (See "Iron and Steel Handbook" published by Maruzen publisher, p. 513, FIG. 221). There is taught that the tension strength of iron-based sintered metal ($kgf/mm^2$) is proportional to the density thereof in the range of 6.2 to 6.8 $g/cm^3$, and then, is constant in the higher range than 6.8 $g/cm^3$.

The present invention is illustrated before in reference to metal material to be used as a starting material for manufacture of the sintered product. Further, referring to ceramic material, the present invention can be illustrated as follows. The ceramic material to be used as a starting material for the product of the present invention may include silicon nitride($Si_3N_4$), silicon carbide(SiC), zirconia($ZrO_2$:$Y_2O_3$) and alumina($Al_2O_3$: 99.5%).

The properties of zirconia, silicon carbide(SiC) and silicon nitride($Si_3N_4$) are shown in Table 1. It is apparent from this table that those ceramic materials can be used to produce the shim of the present invention.

TABLE 1

| | $ZrO_2$ | SiC | $Si_2N_3$ |
|---|---|---|---|
| apparant density | 6.05 | 3.1 | 3.22 |
| porosity (%) | 0 | 0 | 0 |
| pressure strength ($kg/mm^2$) | 320 | 400 | 400 |
| bending strength ($kg/mm^2$) | 130 | 60 | 80 |
| Young's coefficient ($kg/mm^2$) | $2.2 \times 10^4$ | $4.1 \times 10^4$ | $3.1 \times 10^4$ |
| Hardness (Vickers:$kg/mm^2$) | 1,300 | 2,600 | 1,600 |

The size, size distribution, particle size and particle feature of the above ceramic materials should be selected from those materials upon reviewing established methods. One type of the shim of the present invention has the profile of the volumetric density in which the density is maximized at the upper surface thereof to be in contact with the moving cam, and is decreased along the distance from the upper surface edge. Therefore, the method of manufacturing the shim structure from metal or alloy powders or ceramic powders is described below wherein the profile of the shim structure is such that the volumetric density along with the direction of the axis of the shim is changed with maximum at the portion on which the shim takes in contact with the cam, and decreases gradually along the direction toward the bottom of the shim.

(1) In case of four components alloy of Fe-Mo-Cr-Ni, the mixture of Fe powder having average size of 1 micrometer, Mo powder having average size of 0.9 micrometer, Cr powder having average size of 0.8 micrometer and Ni powder having average size of 0.7 micrometer was prepared. Then, the mixture of Fe powder having average size of 5 micrometer, Mo powder having average size of 4 micrometer, Cr powder having average size of 3 micrometer and Ni powder having average size of 2 micrometer was prepared. The former powder mixture is firstly put in the lower portion of the cavity formed in the mould, and then the latter powder mixture is additionally put in the upper portion of the cavity upon and above the former powder mixture. Thereafter, the compression is applied to form a moulding of desired shape. Then, the moulding is fired to form a sintered product of the present invention.

(2) The amount of the lubricating agent to be added to the powder mixture is changed, from the higher lubricant content powder mixture to the lower lubricant content mixture of powder. The higher lubricant content powder mixture is firstly put into a lower portion of the cavity of a compression mould, and then, the lower lubricant content powder mixture is put in the higher portion of the cavity of the mould. After the cavity of the mould is fully filled, the compression force is applied to the mould to form a moulded shape. Then, the moulded shape is fired.

(3) The mixture comprising the desired powder components is prepared, and then, the portion thereof is put in a cavity of a mould for compression formation. Then, it is pressed under the pressure of 5 ton/cm$^2$ for premoulding, and thereafter, the remaining mixture is put in the remain cavity of the mould, and is pressed additionally under the pressure of 6 ton/cm$^2$.

When the process (1) is used, the particle size is changed from 0.1 mm to 0.0001 mm. Further, the size is changed from 0.1 mm to 5 micrometer, if the higher hardness is desired. The compression force to be applied to the mould may preferably 5 to 6 ton/cm$^2$.

One type of the shim of the present invention has the density distribution (or the profile) in which it is maximized about at its central surface portion at which the shim is to be in contact with the cam, and the profile of the distribution curve has a trapezoidal shape, with the minimal density at the peripheral edges.

The manufacture of the shim having the above-mentioned profile can be carried out by one of the following three methods (1), (2) and (3).

(1) A male mould (lower punch mould portion) of a compression forming mould is divided into two portions. Then, after the powder mixture to be pressed is put in the cavity of the female mould, the preparatory pressure of e.g. 5 ton/cm$^2$ is applied to, and then, the final pressure of e.g. 6 ton/cm$^2$ is applied to.

(2) A male mould (lower punch mould portion) of a compression forming mould is divided to form two part of the cavities for moulding. Then, after the first portion of the powder mixture to be pressed is put in the first cavity of the mould, the preparatory pressure of e.g. 5 ton/cm$^2$ is applied to, and then, the remain portion of the powder mixture is put on the pressed mixture, and further, after the male mould is raised, the final pressure of e.g. 6 ton/cm$^2$ is applied to the combined mixture.

(3) A preparatory moulding of the mixture is formed in form of truncated cone, and then, it is put in the desired shape of a compression mould, and a compression pressure at desired level is applied to form a desired moulding.

The inventive shim structure which has been manufactured in accordance with the present invention has porosity to a certain extent, and then can have appropriate oil-impregnating performance. However, the oil-impregnating performance of the shim in accordance with the present invention does not mean that obtained in a sintered oil-impregnated alloy which is manufactured i.e. by mixing Cu powder, Sn powder and graphite powder, and moulding into a certain shape under pressure, and firing, e.g. 18 volume % of oil impregnation.

FIG. 1 shows schematically a cross section of a cam-value tappet movement mechanism using the shim 1 of the present invention. A typical internal combustion engine may have an engine valve 4, a valve spring 5 to press the valve 4 to a closed position, a valve spring retainer for transmitting a pressure of the spring 5 to the valve 4, a valve holder to hold the valve spring 5 on a valve shaft, a tappet 3 reciprocating so as to open and close the valve 4, by a rotation of a cam shaft. FIG. 1 shows a case in which a cam shaft is provided overhead of the engine cylinder (overhead camshaft). The cam is simply raised sections or collars, with high spots on it. When the camshaft rotates, the high spot (called lobe) moves around and pushes away anything it is in contact with. Riding on the cam 2 is a valve tappet 3. As the lobe 2 moves down on the valve tappet 3, the valve tappet goes down. This downward movement caused the valve 4 down it apart from a valve seat 7. Thus, the valve 4 goes down off its seat 7 in the engine cylinder so that the valve 4 opens. When the lobe on the cam 2 moves on around out of the way, the pressure of the spring 5 under the valve forces the valve to move up and reseat. At the same time, the valve tappet 3 is also forced upward so that it remains in contact with the cam 4.

In such moving valve mechanism, a cam 2 mounted on a camshaft (not shown) is rotated in a very high rate, and pushes the valve 4 through the shim 1 and a tappet or lifter 3, so as to open and close acutely periodically the valve 4 to comply the timing of the valve with the revolution rate of the engine. Therefore, much shock and concentrated force must be loaded periodically and repeatedly on the contact surface of the shim 1 with which the cam or lobe 2 is in contact.

The present invention is further illustrated by the following examples to show the structure of the shim in accordance with the present invention, but should not be interpreted for the limitation of the invention.

EXAMPLE 1

Two groups of metal powders as shown in Table 2 were prepared. Then, each components in each amounts and having each particle size as shown in Table 2 was admixed to form respectively the two mixtures of powder: the first mixture and second mixture.

TABLE 2

| | | Size of Particle (micrometer) | |
|---|---|---|---|
| Component | Composition (%) | First Group | Second Group |
| Fe | 71.45 | 3 | 4.5 |
| Mo | 8.0 | 2 | 4 |
| Cr | 17.0 | 1 | 3.5 |

TABLE 2-continued

| Component | Composition (%) | Size of Particle (micrometer) First Group | Second Group |
|---|---|---|---|
| Ni | 1.0 | 0.9 | 1.9 |
| $CaF_2$ | 1.0 | 0.8 | 1.5 |
| Si | 0.85 | 0.7 | 1.2 |
| C | 0.5 | 0.6 | 0.85 |
| Mn | 0.10 | 0.5 | 0.75 |

A small amount of zinc stearate was respectively added to each of the first and second mixtures.

First, the first mixture was put into a lower portion of a cavity of a mould to be used for manufacture of the shim, and further, the second mixture was put on the before-filled first mixture into the upper portion of the cavity of the mould. Then, the filled mixture was pressed by the compression of about 6 ton/cm$^2$ to form a moulding of the desired shape.

The moulding was preheated in an argon gas atmosphere in a continuous furnace at the temperature of 500° C. in a pretreatment step, so as to vaporize zinc stearate lubricant, and then, was fired at the temperature of 1200° C. for sintering. The internal density distribution of the sintered product was measured. It was found that the density is at maximal level on the upper surface of the shim, and is decreased gradually along from the upper surface to the lower bottom surface. The upper surface is to be in contact with the cam for transmitting a compression force from the cam to the valve tappet.

Figure 2:
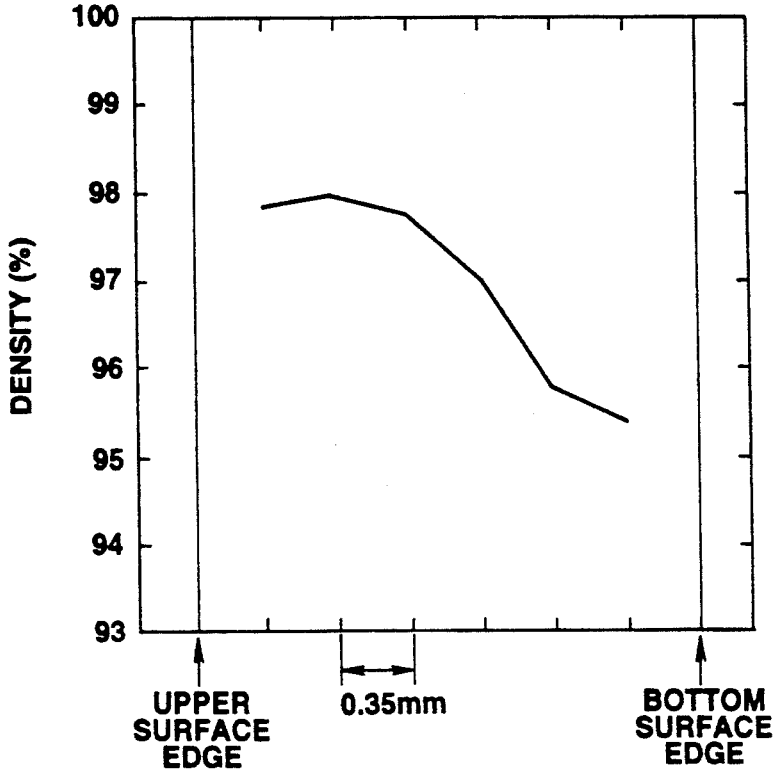
FIG. 2 shows a profile of the density along with perpendicular section of the shim.

The cross-sectional surface of the product along with the direction of the axis of the shim body (having 2.5 mm of thickness) was observed through a metal microscope, and the ratio of pores and other filled portions was measured on each segment of 0.35×0.35 mm. The result is shown in FIG. 2. It is apparent from the graph of FIG. 2 that the density is at maximal level on the upper surface, and is continuously decreased to the lowest level on the lower surface.

EXAMPLE 2

The particles of aluminum and silicon as shown in Table 3 were used to produce a sintered shim structure.

TABLE 3

| Ingredient | Ratio and particle size of used metal powder weight percent | size of particle (micrometer) |
|---|---|---|
| Al | 88.3 | 3 |
| Si | 11.7 | 3 |

A small amount of zinc stearate powder was respectively added to each of Al and Si powders. Al and Si powders were homogeneously admixed, then was divided into two portions. The first half portion of the mixture was put in a lower portion of cavity of the mould, and then, pressed under the pressure of 5 ton/cm$^2$, and the remain portion of the mixture was put on the pressed mixture portion into the other upper portion of the cavity of the mould, and was pressed under the pressure of 6 ton/cm$^2$ to form a two-layered pressed moulding. The moulding was heated in an argon gas atmosphere by a continuous furnace, so as to vaporize the lubricant, and then, was fired at the temperature of 1100° C.

The resulting product was tested in a similar test method to that of Example 1. It was confirmed that the density is maximized at the upper surface on which the shim is in contact with the cam, and then is gradually lowered along with to the lower bottom edge of the resulting shim.

EXAMPLE 3

Each component in the amount and having the particle size as shown in Table 4 was each together admixed with addition of small amount of zinc stearate as a lubricating agent to form a powder mixture of the desired formulation.

TABLE 4

| Ingredient | Ratio and Particle Size of Used Metal Powder Component weight percent | size of particle (micrometer) |
|---|---|---|
| Fe | 84.2 | 2 |
| Mo | 5.0 | 2 |
| Cr | 3.0 | 2 |
| Ni | 4.0 | 2 |
| Nb | 0.8 | 2 |
| C | 1.0 | 2 |
| Co | 1.0 | 2 |
| $CaF_2$ | 1.0 | 2 |

The metal powder components were admixed with addition of a small amount of zinc stearate powder.

The mould for formation of the shim structure was divided into two portions of the cavity of the mould. A male mould to define the cavity of the shim form was divided into two portions, a smaller male mould portion and larger male mould portion.

The whole mixture was put in the cavity of the mould, and a compression force was applied by using the small male mould portion under the pressure of 5 ton/cm$^2$, and then further the compression pressure of 6 ton/cm$^2$ was applied by using the larger male mould portion.

The resulting moulding of the mixture was preheated in an argon gas atmosphere by a continuous furnace at the temperature of 500° C., so as to vaporize the lubricant, and then, was fired for sintering at the temperature of 1200° C.

The internal density distribution of the sintered product was measured along the vertical direction to the axis of the shim, by supersonic damping method.

It was found that the density is at maximal level on the central portion of the surface of the shim, and is decreased gradually along from the central portion to the peripheral ends. The central portion is to be in contact with the cam for transmitting a compression force from the cam to the valve tappet.

The transverse cross-sectional surface of the product was observed by a metal microscope, and the ratio of pores and other filled portions was measured on each segment of 2×2 mm.

Figure 3:
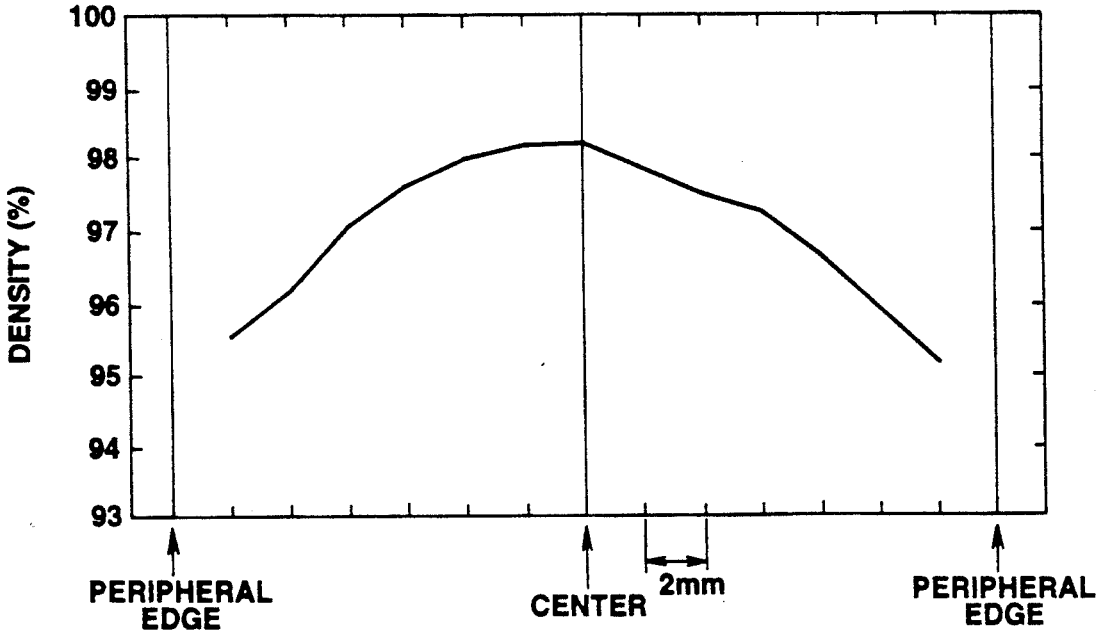
FIG. 3 shows a profile of the density along a traverse direction on the surface of the shim.

The result is shown in FIG. 3. It is apparent from the graph of FIG. 3 that the density is at maximal level on the central portion, and is continuously decreased to the peripheral ends.

EXAMPLE 4

The same powder mixture as that of Example 3 was used to form a preparatory moulding of the mixture. The upper area of the preparatory moulding was one third of the lower area. Such mesa form of preparatory moulding was formed.

This preparatory moulding was introduced in the cavity of the mould for manufacture of the shim, and pressed under the pressure of 6 ton/cm$^2$ to form a moulding for sintering. Then, the moulding was fired under the same condition as that of Example 3, to produce a sintered powder metal shim.

The area density distribution of the sintered shim was measured along the vertical direction to the axis of the shim, by supersonic damping method. It was found that the apparent density is 98% at the central portion, and 95% at the peripheral ends, and mostly uniformly distributed.

EXAMPLE 5

The shims were respectively manufactured from the metal powder compositions of Fe-Ni-Mo-Cu (sample A), Fe-Ni-Cr-Mn-Mo-C (sample B) and Fe-Ni-Cr-Nb-Co-C (sample C: Example 3).

The reference shim was made from carbon-impregnated steel disc. The loading test was carried out by using for an exhaust valve and intake valve the engine of which was operated 6,000 rpm for 50 hours, and thereafter, the abrasion amount was measured and compared with the result from the reference shim.

TABLE 5

| | Abrasion Test of Shim | |
|---|---|---|
| | Abrasion Thickness | |
| Sample | Exhaust valve (micrometer) | Intake valve (micrometer) |
| Reference Shim | 3.6 | 3.2 |
| A | 2.0 | 4.0 |
| B | 1.5 | 3.5 |
| C | 2.7 | 1.0 |

It is apparent that the shim structure of the present invention can be manufactured without restriction that the density of the metal powder should be uniform, and then, the condition of manufacture can be more widely selected.

Only the portion of the shim at which the shim is in contact with the cam when the compression or the shock from the cam is applied to the shim should be attended to have appropriate strength, and it is not necessary to attend the whole surface of the shim. Therefore, the cost of the shim can be reduced, and there is no need of applying additional physical properties.

The manufacture of the shim in accordance with the present invention can be simplified so as to reduce its manufacture cost.

We claim:

1. A structure of a shim to be inserted in a clearance provided between a cam and a tappet in a moving valve mechanism of an internal combustion engine, wherein a volumetric density distribution of a body of the shim has such profile that the density of the shim body is maximized at an upper surface portion of the shim, at which the shim is in contact with the cam when a compression load or shock from the cam is applied to the shim, and the density is gradually decreased from the maximized portion to at least one of a lower surface portion and a peripheral portion of the shim.

2. The structure in accordance with claim 1, wherein the density is gradually decreased from the upper surface portion to the lower bottom surface portion of the shim.

3. The structure in accordance with claim 1, wherein the density is maximized in a central portion of the upper surface portion of the shim, and is decreased along a radial direction from said central portion.

* * * * *